US007384313B2

(12) United States Patent
Kuo

(10) Patent No.: US 7,384,313 B2
(45) Date of Patent: Jun. 10, 2008

(54) CABLE CONNECTOR WITH IMPROVED EMI REPRESSION

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/600,274

(22) Filed: Nov. 14, 2006

(65) Prior Publication Data

US 2007/0178745 A1 Aug. 2, 2007

(30) Foreign Application Priority Data

Nov. 14, 2005 (CN) ..... 2005 1 0095782

(51) Int. Cl.
*H01R 11/30* (2006.01)

(52) U.S. Cl. ..... 439/620.07

(58) Field of Classification Search ..... 439/620.07, 439/620.05, 620.06, 38
See application file for complete search history.

(56) References Cited

U.S. PATENT DOCUMENTS 6,152,775 A * 11/2000 Pavlovic ..... 439/620.07
6,234,843 B1 * 5/2001 Pavlovic ..... 439/620.07
6,461,184 B2 * 10/2002 Nimura ..... 439/352
6,517,384 B2 * 2/2003 Murasawa et al. ..... 439/620.05
6,837,732 B2 * 1/2005 Pavlovic et al. ..... 439/352
6,942,523 B2 * 9/2005 Pavlovic et al. ..... 439/620.07
2003/0162444 A1 * 8/2003 Hayashi ..... 439/620

FOREIGN PATENT DOCUMENTS

TW 230849 9/2004

* cited by examiner

*Primary Examiner*—Gary F. Paumen
(74) *Attorney, Agent, or Firm*—Wei Te Chung

(57) ABSTRACT

A cable connector (100) in accordance with the present invention includes an insulative housing (1) defining a number of channels (13) therethrough, a number of contacts (2) assembled to the insulative housing and respectively received in the channels, a cable (5) including a number of conductors (50) respectively electrically connecting with connecting portions of the contacts to form a number of junctions, an inner mold (6) enclosing the junctions of the cable and the contacts, a magnetic ring (7) assembled to the cable, and an outer cover (8). The magnetic ring is located adjacent to the inner mold and is enclosed by the outer cover together with the inner mold.

19 Claims, 5 Drawing Sheets

CABLE CONNECTOR WITH IMPROVED EMI REPRESSION

BACKGROUND OF THE INVENTION

1. Field of the Invention

The present invention generally relates to a cable connector, and more particularly to a cable connector with improved EMI repression.

2. Description of Related Art

To satisfy current particular commands in market, in April 2002, Hitachi, Panasonic, Phillips, Sony, Thomason, Toshiba and Silicon Image et al. found High-definition Digital Multimedia Interface (HDMI) Association to develop new standard for high-definition video and channel audio. An HDMI cable assembly comprises an insulative housing, a plurality of contacts assembled to the insulative housing, a conductive shell surrounding the insulative housing, a cable electrically connecting with the contacts, a magnetic ring for shielding the cable and an outer cover. In high-definition video signal transmission, the reliability of signal transmission is highly demanded to assure the image quality, thus, a magnetic ring is particularly needed for EMI repression. Usually, the magnetic ring is arranged to encircle the cable and spaced from the junctions of the cable and the contacts a certain distance. Then, the magnetic ring is molded to be fixed to the cable, and the outer cover is molded to cover the rear end of the insulative housing, the junctions of the cable and the contacts. However, the EMI repression effect is not perfect since the certain distance between the magnetic ring and the junctions of the cable and the contacts. In addition, the double mold process complexes the manufacture flow and thus, is not in favor of the improvement of the production efficiency.

TW Patent No. 230849 discloses an electrical connector directly arranging the magnetic ring in the electrical connector. However, with the miniature trend of the electric industry, the inner space of the electrical connector is too limited to arrange the magnetic ring, otherwise, the size of the electrical connector is increased to breach from the current trend. Therefore, a cable connector with improved structure for EMI repression is highly desired to address above problems.

BRIEF SUMMARY OF THE INVENTION

Accordingly, an object of the present invention is to provide a cable connector with improved molded structure for perfect EMI repression.

In order to achieve the above-mentioned object, a cable connector in accordance with the present invention comprises an insulative housing defining a plurality of channels therethrough, a plurality of contacts assembled to the insulative housing and respectively received in the channels, a cable comprising a plurality of conductors respectively electrically connecting with connecting portions of the contacts to form a plurality of junctions, an inner mold enclosing the junctions of the cable and the contacts, a magnetic ring assembled to the cable, and an outer cover. The magnetic ring is located adjacent to the inner mold and is enclosed by the outer cover together with the inner mold.

Other objects, advantages and novel features of the invention will become more apparent from the following detailed description of the present embodiment when taken in conjunction with the accompanying drawings.

DETAILED DESCRIPTION OF THE INVENTION

Figure 1:
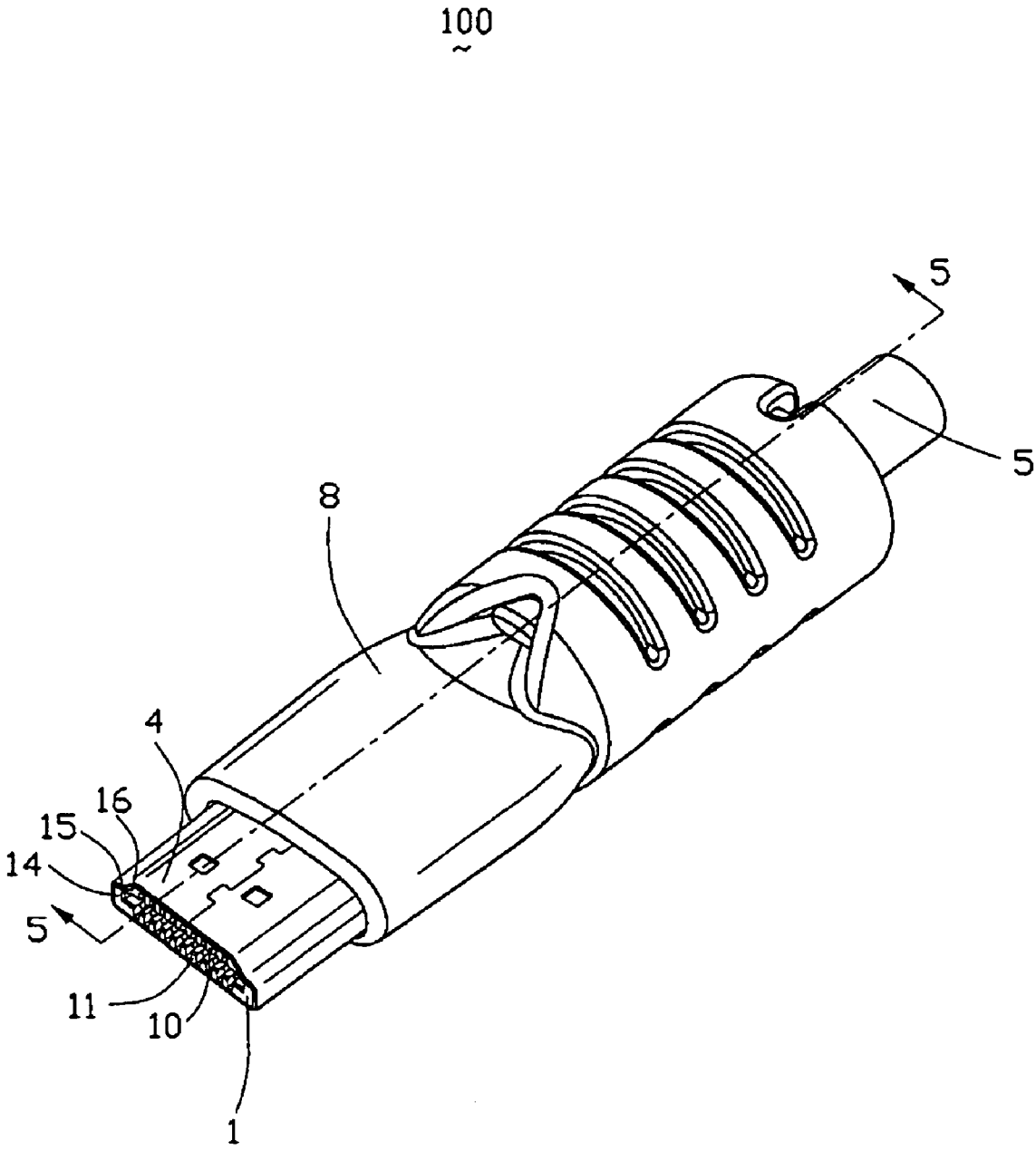
FIG. 1 is an assembled, perspective view of a cable connector in accordance with the present invention.
Figure 2:
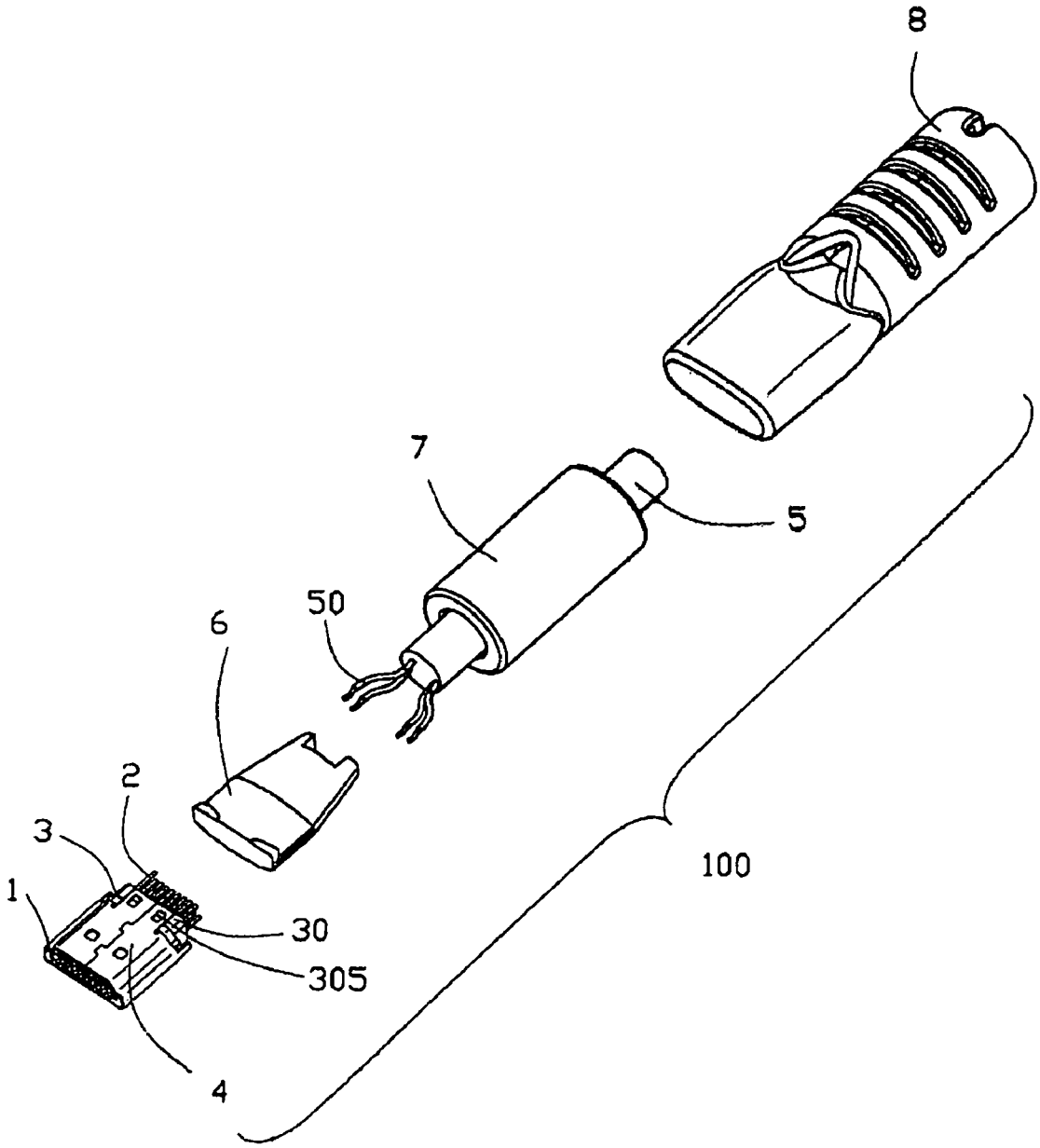
FIG. 2 is an exploded, perspective view of FIG. 1.
Figure 3:
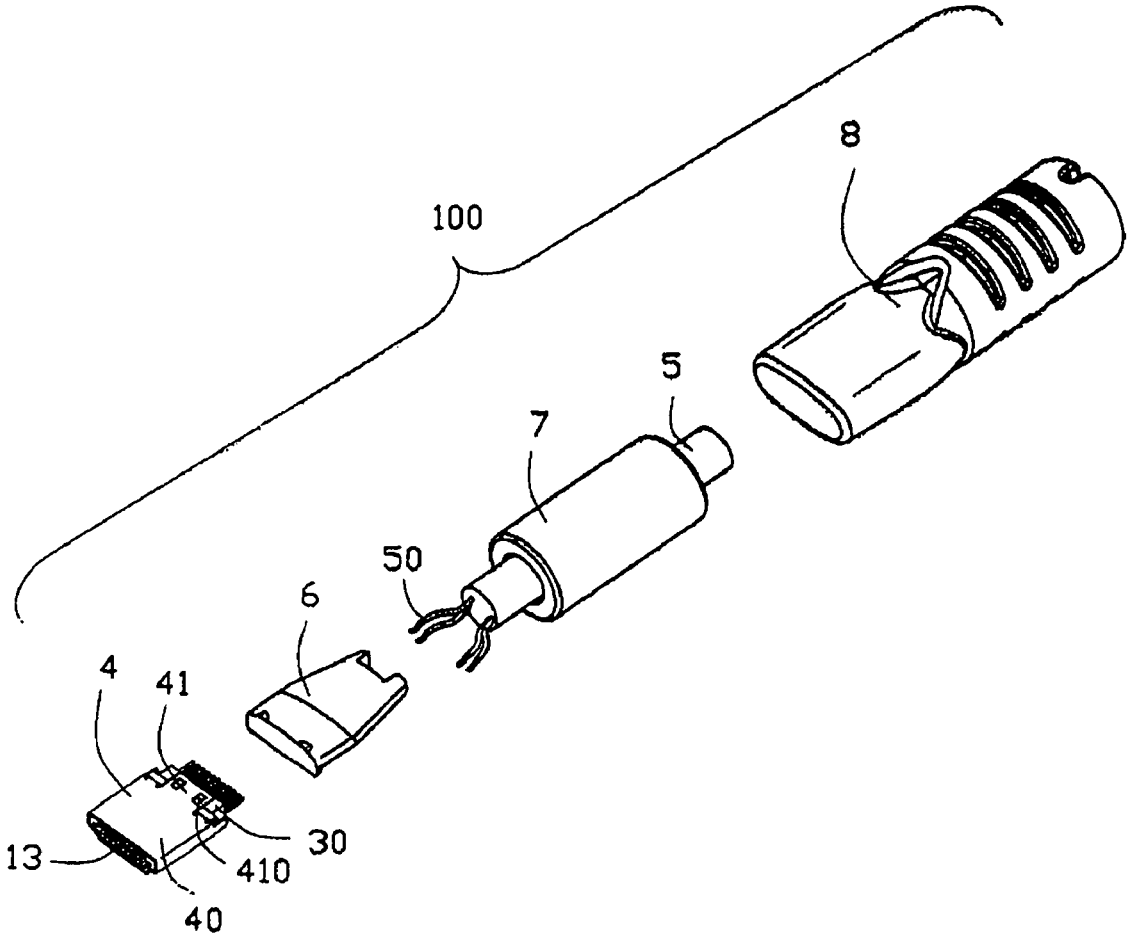
FIG. 3 is a view similar to FIG. 2, but viewed from a different aspect.

Reference will now be made to the drawing figures to describe the present invention in detail.

Referring to FIGS. 1-4, a cable connector 100 in accordance with the present invention comprises an insulative housing 1, a plurality of contacts 2 assembled to the insulative housing 1, a spacer 3 sealing the rear end of the insulative housing 1, a conductive shell 4 shielding the insulative housing 1, a cable 5 electrically connecting with the contacts 2, an inner mold 6 enclosing the junctions between the contacts 2 and the cable 5, a magnetic ring 7 located adjacent to the inner mold 6 and circling the cable 5 and an outer cover 8 enclosing the rear end of the conductive shell 4, the inner mold 6 and the magnetic ring 7.

The insulative housing 1 comprises a pair of first walls 10, 11 parallel to each other and with different lengths, a pair of second walls 14 vertically extending from opposite ends of the lower first wall 11, a pair of third walls 15 extending toward each other from upper ends of the second walls 14, and a pair of inclined fourth walls 16 respectively connecting with the third walls 15 and the upper first wall 10. Thus, a receiving space 12 is circumscribed by the walls 10, 1 1, 14, 15 and 16. The first walls 10, 11 respectively define a plurality of channels 13 to communicate with the receiving space 12. In addition, the number of the channels 13 of the upper first wall 10 is not equal to that of the channels 13 of the lower first wall 11.

The spacer 3 forms a plurality of grooves (not labeled) therethrough corresponding to the channels 13 of the insulative housing 1. The contacts 2 respectively protrude through the grooves with mating portions 21 received in the channels 13, connecting portions 22 electrically connecting with conductors 50 of the cable 5, preferably soldering in the embodiment. The rear end 30 of the spacer 3 forms two pairs of protrusions 305 respectively on upper and lower surfaces thereof. The spacer 3 is assembled to the insulative housing 1 from rear-to-back direction and seals the rear portion of the insulative housing 1, the front end (not labeled) of the spacer 3 is received in the rear of the receiving space 12.

Referring to FIGS. 1-5, the conductive shell 4 is stamped from a metal sheet and then bent to form the current shape. The conductive shell 4 comprises a body portion 40 enclosing the insulative housing 1 and a pair of stretching portions 41 extending rearwardly from the body portion 40. Corresponding to the protrusions 305 of the spacer 3, each stretching portion 40 forms a pair of rectangular engaging holes 410 serving as blocking means. The conductive shell 4 encloses the outer periphery of the insulative housing 1 and the engaging holes 410 thereof latchably engage with the protrusions 305 of the spacer 3 assembled to the insulative housing 1. Via the above engagement, the conductive shell 4 and the spacer 3 both assembled to the insulative housing 1 are reliably assembled to each other.

The magnetic ring 7 is cylindrical and the inner diameter thereof is slightly bigger than the diameter of the cable 5 and circles the cable 5. The magnetic ring 7 is made from ferrite core material for EMI repression to assure the reliability of the signal transmission of the cable connector 100.

Figure 4:
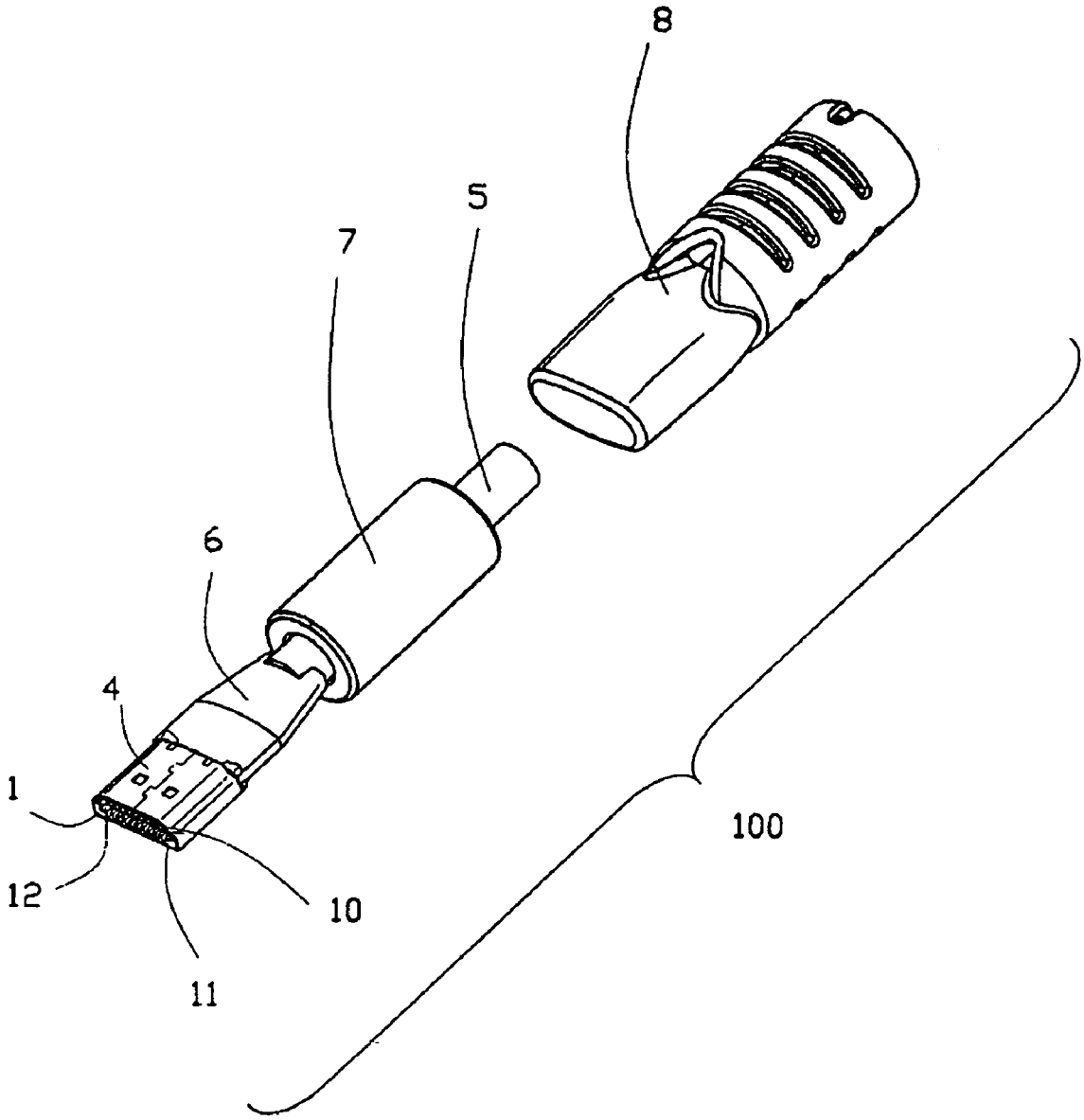
FIG. 4 is a partially assembled view of FIG. 1.
Figure 5:
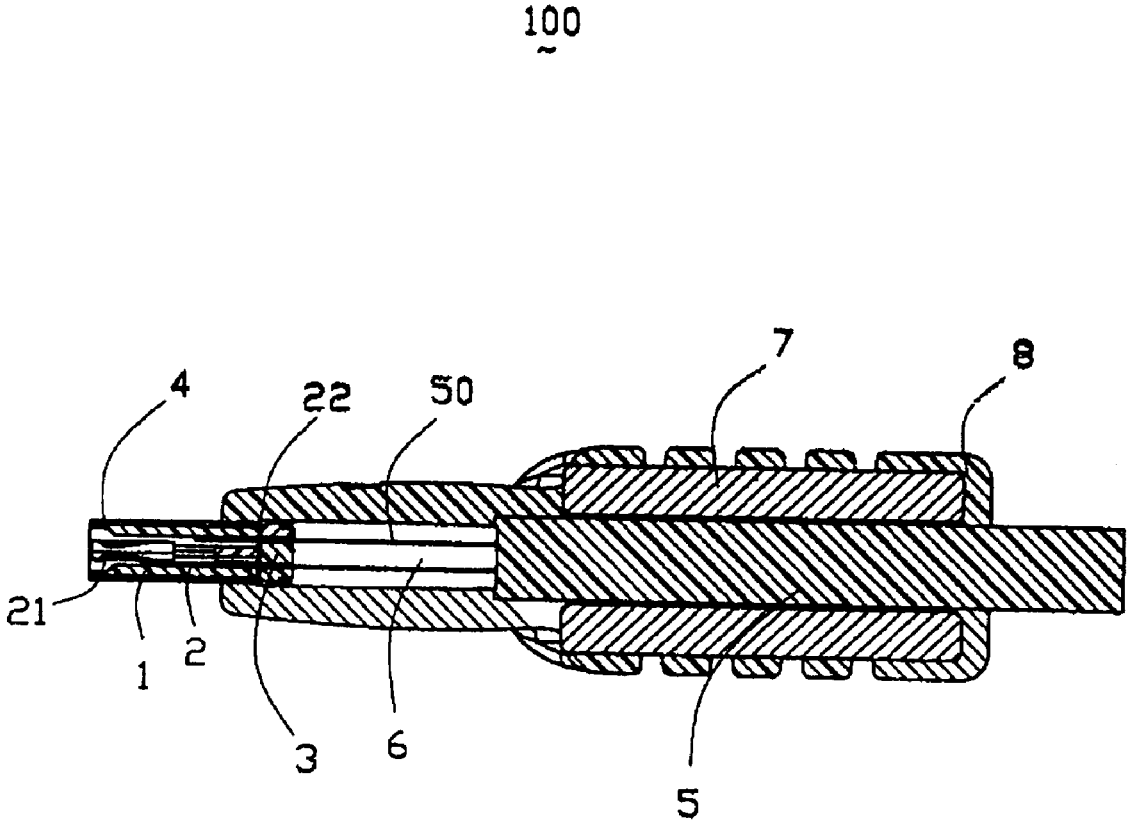
FIG. 5 is a cross-section view taken along line 5-5 of FIG. 1.

Please refer to FIG. 4, after the assembly of the insulative housing 1, the contacts 2, the spacer 3, the conductive shell 4 and the cable 5, the inner mold 6 is formed by overmolding method and molded with the rear portion of the insulative housing 1, the stretching portions 41 of the conductive shell 4, the rear end 30 of the spacer 3 and the junctions of the contacts 2 and the cable 5. Then, the magnetic ring 7 is assembled to the cable 5 and located adjacent to the inner mold 6, preferably abutting against rear surface of the inner mold 6 for locating adjacent to the junctions of the cable 5 and the contacts 2 as near as possible. Finally, the outer cover 8 is assembled or overmolded to the above assembly, and thus, encloses the rear end of the conductive shell 4, the magnetic ring 7 and the inner mold 6. Since the inner diameter of the magnetic ring 7 is only slightly bigger than the diameter of the cable, the magnetic ring 7 is hardly to slide along the cable 5 when molding the outer cover 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector, comprising:

an insulative housing defining a plurality of channels therethrough;

a plurality of contacts assembled to the insulative housing and respectively received in the channels, each contact comprising a mating portion exposed in corresponding channel and a connecting portion exposed beyond the insulative housing;

a cable comprising a plurality of conductors respectively electrically connecting with the connecting portions of the contacts to form a plurality of junctions;

an inner mold enclosing the junctions of the cable and the contacts;

a magnetic ring assembled to the cable; and an outer cover; and wherein the magnetic ring is located adjacent to the inner mold and is enclosed by the outer cover together with the inner mold.

2. The cable connector as claimed in claim 1, wherein the outer cover is made from insulative material and overmolded with the rear end of the insulative housing, the magnetic ring and the inner mold.

3. The cable connector as claimed in claim 1, wherein the magnetic ring is made from ferrite core material.

4. The cable connector as claimed in claim 1, wherein the magnetic ring abuts against rear surface of the inner mold.

5. The cable connector as claimed in claim 1, further comprising a conductive shell enclosing the insulative housing, and wherein the rear portion of the conductive shell is enclosed by the outer cover.

6. The cable connector as claimed in claim 5, further comprising a spacer assembled to seal the rear end of the insulative housing, and wherein the spacer latchably engages with the conductive shell.

7. The cable connector as claimed in claim 6, wherein the spacer forms at least one protrusion in rear portion thereof, and wherein the conductive shell forms an engaging hole to latchably receive the at least one protrusion therein.

8. The cable connector as claimed in claim 1, wherein the insulative housing comprises a pair of first walls parallel to each other, and wherein the upper first wall and the lower first wall respectively define a row of channels, the numbers of the two rows of channels are different from each other.

9. The cable connector as claimed in claim 8, wherein the upper first wall is shorter than the lower first wall.

10. The cable connector as claimed in claim 9, wherein the housing comprises a pair of second walls respectively extending vertically from opposite ends of the lower first wall, a pair of third walls extending toward each other from upright ends of the pair of second walls, and a pair of inclined fourth walls respectively connecting with the third walls and the opposite ends of the upper first wall.

11. The cable connector as claimed in claim 10, wherein the insulative housing defines a receiving space circumscribed by the first, second, third and fourth walls, and wherein the channels are in communication with the receiving space.

12. The cable connector as claimed in claim 1, wherein the inner diameter of the magnetic ring is slightly bigger than the diameter of the cable.

13. A method of assembling a cable connector, comprising the steps of:

a) providing an insulative housing comprising an upper wall and a lower wall each defining a row of channels;

b) providing a plurality of contacts, each contact comprising a mating portion received in corresponding channel of the insulative housing and a connecting portion exposed beyond the insulative housing;

c) providing a cable comprising a plurality of conductors respectively electrically connecting with the connecting portions of the contacts to form a plurality of junctions;

d) providing an inner mold overmolding with the junctions of the cable and the contacts;

e) providing a magnetic ring assembled to the cable and located adjacent to the inner mold; and f) providing an outer cover enclosing the inner mold and the magnetic ring.

14. The method of assembling the cable connector as claimed in claim 13, wherein the magnetic ring is made from ferrite core material.

15. The method of assembly the cable connector as claimed in claim 13, wherein the cable connector is in accordance with HDMI (High-Definition Digital Multimedia Interface) standard.

16. A cable connector comprising:

an insulative housing defining a mating port;

a plurality of contacts disposed in the housing and exposed to the mating port;

a cable comprising a plurality of conductors split away from one another at a front end portion of the cable, and respectively electrically connecting with the contacts to form a plurality of junctions thereabouts;

an inner mold enclosing the junctions of the cable and the contacts;

a magnetic ring surrounding the cable behind the front end portion thereof; and a unitary outer cover, wherein the magnetic ring is located behind the inner mold while both the magnetic ring and the inner mold are enclosed by the outer cover.

17. The cable connector as claimed in claim 16, wherein the outer cover includes a front flat section and a rear round section to respectively comply with contours of said inner mold and said magnetic ring.

18. The cable connector as claimed in claim 17, wherein the inner mold defines an outer profile generally in compliance with the mating port.

19. The cable connector as claimed in claim 16, wherein the inner mold is axially distanced from the magnetic ring with a space filled with the outer cover.

* * * * *